US011452901B2

(12) United States Patent
Lagree et al.

(10) Patent No.: US 11,452,901 B2
(45) **Date of Patent: *Sep. 27, 2022**

(54) EXERCISE MACHINE WITH ELECTROMAGNETIC RESISTANCE SELECTION

(71) Applicant: Lagree Technologies, Inc., Chatsworth, CA (US)

(72) Inventors: Sebastien Anthony Louis Lagree, Chatsworth, CA (US); Samuel D. Cox, Yuba City, CA (US); Todd G. Remund, Yuba City, CA (US)

(73) Assignee: Lagree Technologies, Inc., Chatsworth, CA (US)

( * ) Notice: Subject to any disclaimer, the term of this patent is extended or adjusted under 35 U.S.C. 154(b) by 6 days.

This patent is subject to a terminal disclaimer.

(21) Appl. No.: 17/351,722

(22) Filed: Jun. 18, 2021

(65) Prior Publication Data

US 2021/0308514 A1 Oct. 7, 2021

Related U.S. Application Data

(63) Continuation of application No. 16/686,405, filed on Nov. 18, 2019, now Pat. No. 11,040,234, which is a (Continued)

(51) Int. Cl.
*A63B 21/00* (2006.01)
*A63B 24/00* (2006.01)
(Continued)

(52) U.S. Cl.
CPC ..... *A63B 21/0615* (2013.01); *A63B 21/0052* (2013.01); *A63B 21/00065* (2013.01); (Continued)

(58) Field of Classification Search
CPC ..... A63B 21/00065; A63B 21/0052; A63B 21/00192; A63B 21/023; A63B 21/025; (Continued)

(56) References Cited

U.S. PATENT DOCUMENTS 131,886 A 10/1872 Little
339,638 A 4/1886 Goldie
(Continued)

FOREIGN PATENT DOCUMENTS

JP 106278 A 1/1998
KR 1020040097734 B1 11/2004
(Continued)

OTHER PUBLICATIONS http://www.puzzlebox.io/brainstorms/; Puzzlebox Brainstorms Website Article; Jun. 13, 2016.
(Continued)

*Primary Examiner* — Megan Anderson
(74) *Attorney, Agent, or Firm* — Neustel Law Offices

(57) ABSTRACT

An exercise machine with electromagnetic resistance selection for changing exercise resistance settings by engaging more or fewer resistance biasing members using a electromagnets. An example implementation includes a movable carriage configured to move substantially along the length of one or more rails. A plurality of resistance biasing members are removably attachable between a stationary biasing member bracket affixed to the machine structure and the movable carriage. A controller changes the resistance settings against the movable carriage by electrically attaching or detaching any preferred number of resistance biasing members between the machine structure and movable carriage.

20 Claims, 10 Drawing Sheets

Related U.S. Application Data continuation of application No. 15/647,330, filed on Jul. 12, 2017, now Pat. No. 10,478,656.

(60) Provisional application No. 62/361,211, filed on Jul. 12, 2016.

(51) Int. Cl.

| | |
|---|---|
| ***A63B 21/005*** | (2006.01) |
| ***A63B 21/02*** | (2006.01) |
| ***A63B 22/20*** | (2006.01) |
| ***A63B 23/02*** | (2006.01) |
| ***A63B 21/06*** | (2006.01) |
| ***A63B 21/04*** | (2006.01) |
| ***A63B 22/00*** | (2006.01) |
| *A63B 21/055* | (2006.01) |

(52) U.S. Cl.

CPC ..... *A63B 21/00192* (2013.01); *A63B 21/023* (2013.01); *A63B 21/0442* (2013.01); *A63B 21/4033* (2015.10); *A63B 22/0087* (2013.01); *A63B 22/203* (2013.01); *A63B 24/0087* (2013.01); *A63B 21/025* (2013.01); *A63B 21/055* (2013.01); *A63B 21/0552* (2013.01); *A63B 21/4034* (2015.10); *A63B 21/4035* (2015.10); *A63B 22/001* (2013.01); *A63B 22/0007* (2013.01); *A63B 23/02* (2013.01); *A63B 2209/08* (2013.01); *A63B 2225/50* (2013.01)

(58) Field of Classification Search

CPC ..... A63B 21/0552; A63B 21/055; A63B 21/4033; A63B 21/4034; A63B 21/4035; A63B 22/001; A63B 22/0007; A63B 22/0087; A63B 22/203; A63B 22/0089; A63B 23/02; A63B 24/0087; A63B 2209/08

See application file for complete search history.

(56) References Cited

U.S. PATENT DOCUMENTS

| | | | |
|---|---|---|---|
| 1,621,477 | A | 8/1925 | Pilates |
| 3,770,267 | A | 11/1973 | McCarthy |
| 3,806,094 | A | 4/1974 | Harken |
| 4,013,068 | A | 3/1977 | Settle |
| 4,759,540 | A | 7/1988 | Yu |
| 4,798,378 | A | 1/1989 | Jones |
| 5,066,005 | A | 11/1991 | Luecke |
| 5,201,694 | A | 4/1993 | Zappel |
| 5,263,913 | A | 11/1993 | Boren |
| 5,295,935 | A | 3/1994 | Wang |
| 5,316,535 | A | 5/1994 | Bradbury |
| 5,365,934 | A | 11/1994 | Leon |
| D362,700 | S | 9/1995 | Breibart |
| D382,319 | S | 8/1997 | Gerschefske |
| 5,681,249 | A | 10/1997 | Endelman |
| 5,738,104 | A | 4/1998 | Lo |
| 5,812,978 | A | 9/1998 | Nolan |
| 5,885,197 | A | 3/1999 | Barton |
| 5,967,955 | A | 10/1999 | Westfall |
| 5,989,163 | A | 11/1999 | Rodgers, Jr. |
| 6,045,491 | A | 4/2000 | McNergney |
| 6,152,856 | A | 11/2000 | Studor |
| 6,179,753 | B1 | 1/2001 | Barker |
| 6,261,205 | B1 | 7/2001 | Elefson |
| 6,626,802 | B1 | 9/2003 | Rodgers, Jr. |
| 6,790,162 | B1 | 9/2004 | Ellis |
| 6,790,163 | B1 | 9/2004 | Van De Laarschot |
| 6,929,589 | B1 | 8/2005 | Bruggemann |
| 7,163,500 | B2 | 1/2007 | Endelman |
| 7,192,387 | B2 | 3/2007 | Mendel |
| 7,448,986 | B1 | 11/2008 | Porth |
| 7,537,554 | B2 | 5/2009 | Zhuang |
| 7,803,095 | B1 | 9/2010 | Lagree |
| 7,871,359 | B2 | 1/2011 | Humble |
| 7,878,955 | B1 | 2/2011 | Ehrlich |
| 7,914,420 | B2 | 3/2011 | Daly |
| 7,931,570 | B2 | 4/2011 | Hoffman |
| 7,967,728 | B2 | 6/2011 | Zavadsky |
| 8,162,802 | B2 | 4/2012 | Berg |
| 8,249,714 | B1 | 8/2012 | Hartman |
| 8,287,434 | B2 | 10/2012 | Zavadsky |
| 8,303,470 | B2 | 11/2012 | Stewart |
| 8,500,611 | B2 | 8/2013 | Hoffman |
| 8,585,554 | B2 | 11/2013 | Shavit |
| 8,641,585 | B2 | 2/2014 | Lagree |
| 8,812,075 | B2 | 8/2014 | Nguyen |
| 8,852,062 | B2 | 10/2014 | Dorsay |
| 8,911,328 | B2 | 12/2014 | Alessandri |
| 9,011,291 | B2 | 4/2015 | Birrell |
| 9,022,909 | B2 | 5/2015 | Kermath |
| 9,199,123 | B2 | 12/2015 | Solow |
| 9,283,422 | B2 | 3/2016 | Lagree |
| 9,533,184 | B1 | 1/2017 | Lagree |
| 10,046,193 | B1 | 8/2018 | Aronson |
| 10,155,129 | B2 | 12/2018 | Lagree |
| 2001/0056011 | A1 | 12/2001 | Endelman |
| 2002/0025888 | A1 | 2/2002 | Germanton |
| 2002/0025891 | A1 | 2/2002 | Colosky, Jr. |
| 2002/0082146 | A1 | 6/2002 | Stearns |
| 2002/0137607 | A1 | 9/2002 | Endelman |
| 2003/0119635 | A1 | 6/2003 | Arbuckle |
| 2004/0043873 | A1 | 3/2004 | Wilkinson |
| 2005/0085351 | A1 | 4/2005 | Kissel |
| 2005/0130810 | A1 | 6/2005 | Sands |
| 2005/0164853 | A1 | 7/2005 | Naidus |
| 2005/0164856 | A1 | 7/2005 | Parmater |
| 2006/0046914 | A1 | 3/2006 | Endelman |
| 2006/0105889 | A1 | 5/2006 | Webb |
| 2006/0183606 | A1 | 8/2006 | Parmater |
| 2006/0199712 | A1 | 9/2006 | Barnard |
| 2007/0202992 | A1 | 8/2007 | Grasshoff |
| 2007/0224582 | A1 | 9/2007 | Hayashino |
| 2007/0270293 | A1 | 11/2007 | Zhuang |
| 2008/0051256 | A1 | 2/2008 | Ashby |
| 2008/0058174 | A1 | 3/2008 | Barnard |
| 2008/0070765 | A1 | 3/2008 | Brown |
| 2008/0139975 | A1 | 6/2008 | Einav |
| 2008/0242519 | A1 | 10/2008 | Parmater |
| 2008/0248935 | A1 | 10/2008 | Solow |
| 2008/0254952 | A1 | 10/2008 | Webb |
| 2009/0005698 | A1 | 1/2009 | Lin |
| 2009/0023561 | A1 | 1/2009 | Ross |
| 2009/0291805 | A1 | 11/2009 | Blum |
| 2009/0312152 | A1 | 12/2009 | Kord |
| 2010/0016131 | A1 | 1/2010 | Hoffman |
| 2010/0125026 | A1 | 5/2010 | Zavadsky |
| 2010/0144499 | A1 | 6/2010 | Graham |
| 2010/0227748 | A1 | 9/2010 | Campanaro |
| 2010/0267524 | A1 | 10/2010 | Stewart |
| 2011/0018233 | A1 | 1/2011 | Senner |
| 2011/0039665 | A1 | 2/2011 | Dibble |
| 2011/0077127 | A1 | 3/2011 | Ishii |
| 2011/0143898 | A1 | 6/2011 | Trees |
| 2011/0152045 | A1 | 6/2011 | Horne |
| 2011/0166002 | A1 | 7/2011 | Savsek |
| 2011/0172069 | A1 | 7/2011 | Gerschefske |
| 2011/0184559 | A1 | 7/2011 | Benabid |
| 2012/0015334 | A1 | 1/2012 | Hamilton |
| 2012/0088634 | A1 | 4/2012 | Heidecke |
| 2012/0143020 | A1 | 6/2012 | Bordoley |
| 2012/0190505 | A1 | 7/2012 | Shavit |
| 2012/0202656 | A1 | 8/2012 | Dorsay |
| 2012/0228385 | A1 | 9/2012 | DeLuca |
| 2012/0295771 | A1 | 11/2012 | Lagree |
| 2013/0072353 | A1 | 3/2013 | Alessandri |
| 2013/0150216 | A1 | 6/2013 | Bell |
| 2013/0196835 | A1 | 8/2013 | Solow |
| 2013/0210578 | A1 | 8/2013 | Birrell |
| 2014/0011645 | A1 | 1/2014 | Johnson |

(56) References Cited

U.S. PATENT DOCUMENTS

| | | | | |
|---|---|---|---|---|
| 2014/0066257 | A1 | 3/2014 | Shavit | |
| 2014/0087922 | A1 | 3/2014 | Bayerlein | |
| 2014/0100089 | A1 | 4/2014 | Kermath | |
| 2014/0121076 | A1 | 5/2014 | Lagree | |
| 2014/0121078 | A1 | 5/2014 | Lagree | |
| 2014/0121079 | A1 | 5/2014 | Lagree | |
| 2014/0141948 | A1* | 5/2014 | Aronson | A63B 22/0087 482/128 |
| 2014/0148715 | A1 | 5/2014 | Alexander | |
| 2014/0213415 | A1 | 7/2014 | Parker | |
| 2015/0012111 | A1 | 1/2015 | Contreras-Vidal | |
| 2015/0024914 | A1 | 1/2015 | Lagree | |
| 2015/0057127 | A1 | 2/2015 | Lagree | |
| 2015/0065318 | A1 | 3/2015 | Lagree | |
| 2015/0072841 | A1 | 3/2015 | Lagree | |
| 2015/0105223 | A1 | 4/2015 | Bissu | |
| 2015/0141204 | A1 | 5/2015 | Lagree | |
| 2015/0217164 | A1 | 8/2015 | Lagree | |
| 2015/0220523 | A1 | 8/2015 | Lagree | |
| 2015/0246263 | A1 | 9/2015 | Campanaro | |
| 2015/0297944 | A1 | 10/2015 | Lagree | |
| 2015/0329011 | A1 | 11/2015 | Kawai | |
| 2015/0343250 | A1 | 12/2015 | Lagree | |
| 2015/0360068 | A1 | 12/2015 | Lagree | |
| 2015/0360083 | A1* | 12/2015 | Lagree | A63B 24/0087 482/130 |
| 2015/0360113 | A1* | 12/2015 | Lagree | A63B 21/4031 482/121 |
| 2015/0364058 | A1 | 12/2015 | Lagree | |
| 2015/0364059 | A1 | 12/2015 | Marks | |
| 2015/0367166 | A1 | 12/2015 | Lagree | |
| 2016/0008657 | A1 | 1/2016 | Lagree | |
| 2016/0059060 | A1 | 3/2016 | Lagree | |
| 2016/0059061 | A1 | 3/2016 | Lagree | |
| 2016/0074691 | A1 | 3/2016 | Pearce | |
| 2016/0096059 | A1 | 4/2016 | Lagree | |
| 2016/0166870 | A1 | 6/2016 | Lagree | |
| 2016/0193496 | A1 | 7/2016 | Lagree | |
| 2016/0256733 | A1 | 9/2016 | Lagree | |
| 2016/0271452 | A1 | 9/2016 | Lagree | |
| 2016/0317858 | A1 | 11/2016 | Lagree | |
| 2016/0346593 | A1 | 12/2016 | Lagree | |
| 2016/0361602 | A1 | 12/2016 | Lagree | |
| 2017/0014664 | A1 | 1/2017 | Lagree | |
| 2017/0014672 | A1 | 1/2017 | Lagree | |
| 2017/0036057 | A1 | 2/2017 | Lagree | |
| 2017/0036061 | A1 | 2/2017 | Lagree | |
| 2017/0043210 | A9 | 2/2017 | Lagree | |
| 2017/0065846 | A1 | 3/2017 | Lagree | |
| 2017/0072252 | A1 | 3/2017 | Lagree | |
| 2017/0087397 | A1 | 3/2017 | Lagree | |
| 2017/0100625 | A1 | 4/2017 | Lagree | |
| 2017/0100629 | A1 | 4/2017 | Lagree | |
| 2017/0106232 | A1 | 4/2017 | Lagree | |
| 2017/0113091 | A1 | 4/2017 | Lagree | |
| 2017/0120101 | A1 | 5/2017 | Lagree | |
| 2017/0144013 | A1 | 5/2017 | Lagree | |
| 2017/0157452 | A1 | 6/2017 | Lagree | |
| 2017/0157458 | A1 | 6/2017 | Lagree | |
| 2017/0165518 | A1 | 6/2017 | Lagree | |
| 2017/0165555 | A1 | 6/2017 | Lagree | |
| 2017/0189740 | A1 | 7/2017 | Lagree | |
| 2017/0189741 | A1 | 7/2017 | Lagree | |
| 2017/0209728 | A1 | 7/2017 | Lagree | |
| 2017/0239526 | A1 | 8/2017 | Lagree | |
| 2017/0246491 | A1 | 8/2017 | Lagree | |
| 2017/0246499 | A1 | 8/2017 | Lagree | |
| 2017/0296865 | A1 | 10/2017 | Lagree | |
| 2017/0304673 | A1 | 10/2017 | Lagree | |
| 2017/0326406 | A1 | 11/2017 | Lagree | |
| 2017/0340947 | A1 | 11/2017 | Lagree | |
| 2017/0354840 | A1 | 12/2017 | Lagree | |
| 2018/0015319 | A1 | 1/2018 | Lagree | |
| 2018/0021621 | A1 | 1/2018 | Lagree | |
| 2018/0021655 | A1 | 1/2018 | Lagree | |
| 2018/0036583 | A1 | 2/2018 | Lagree | |
| 2018/0056109 | A1 | 3/2018 | Lagree | |
| 2018/0056133 | A1 | 3/2018 | Lagree | |
| 2018/0111020 | A1 | 4/2018 | Lagree | |
| 2018/0111033 | A1 | 4/2018 | Lagree | |
| 2018/0117392 | A1 | 5/2018 | Lagree | |
| 2018/0133532 | A1 | 5/2018 | Lagree | |
| 2018/0133533 | A1 | 5/2018 | Lagree | |
| 2018/0133534 | A1 | 5/2018 | Lagree | |
| 2018/0133542 | A1 | 5/2018 | Lagree | |

FOREIGN PATENT DOCUMENTS

| | | | |
|---|---|---|---|
| WO | 2004/096376 | A1 | 11/2004 |
| WO | 2014084742 | A1 | 6/2014 |

OTHER PUBLICATIONS http://tera.lunar-europe.com; TERA Fitness Mat; Lunar Europe; Jun. 8, 2014.

PCT International Search and Opinion from International Searching Authority for PCT/US2016/022888; dated Jul. 25, 2016.

PCT Preliminary Report on Patentability from International Searching Authority for PCT/US2016/022888; dated Sep. 28, 2017.

PCT International Search and Opinion from International Searching Authority for PCT/US2017/041638; dated Sep. 28, 2017.

http://www.cognionics.com/index.php/products/hd-eeg-systems/mobile-eeg-cap; Cognionics Mobile-72 Wireless EEG System; Jun. 14, 2016.

http://www.cognionics.com/index.php/products/mini-systems/dry-eeg-headband; Cognionics Dry EEG Headband; Jun. 14, 2016.

http://www.cognionics.com/index.php/products/mini-systems/multi-position-dry-headband; Cognionics Multi-Position Dry EEG Headband; Jun. 14, 2016.

http://www.cognionics.com/index.php/products/hd-eeg-systems/quick-20-dry-headset; Cognionics Quick-20 Dry EEG Headset; Jun. 14, 2016.

http://www.cognionics.com/index.php/products/hd-eeg-systems/72-channel-system; Cognionics HD-72 Overview; Jun. 14, 2016.

http://www.brainproducts.com/productdetails.php?id=63&tab=1; LiveAmp Overview; Jun. 14, 2016.

https://www.youtube.com/watch?v=xj2xuGsB3yo; Screenshot of YouTube Video "Iphone free App (Dec. 16, 2010) Finger Balance"; tuuske; Dec. 16, 2010.

PCT International Search Report and Written Opinion for PCT/US2015/047746 from the Korean Intellectual Property Office; dated Nov. 19, 2015.

PCT International Search Report and Written Opinion for PCT/US2015/047763 from the Korean Intellectual Property Office; dated Nov. 19, 2015.

PCT Preliminary Report on Patentability from International Searching Authority for PCT/US2017/041638; dated Jan. 24, 2019.

* cited by examiner

| Machine State | Engaged Biasing Members | | | | Total Force (lbs) |
|---|---|---|---|---|---|
| | 10 lbs | 20 lbs | 40 lbs | 60 lbs | |
| Condition 1 (500) | | | | | 0 |
| Condition 2 (501) | 511a | | | | 10 |
| Condition 3 (502) | 511a | 511b | | | 30 |
| Condition 4 (503) | 511a | 511b | 511c | | 70 |
| Condition 5 (504) | 511a | 511b | 511c | 511d | 130 |
| Condition 6 (505) | | 511b | | | 20 |
| Condition 7 (506) | | 511b | 511c | | 60 |
| Condition 8 (507) | | 511b | 511c | 511d | 120 |
| Condition 9 (508) | | | 511c | | 40 |
| Condition 10 (509) | | | 511c | 511d | 100 |
| Condition 11 (510) | | | | 511d | 60 |

EXERCISE MACHINE WITH ELECTROMAGNETIC RESISTANCE SELECTION

CROSS REFERENCE TO RELATED APPLICATIONS

The present application is a continuation of U.S. application Ser. No. 16/686,405 filed on Nov. 18, 2019 which issues as U.S. Pat. No. 11,040,234 on Jun. 22, 2021, which is a continuation of U.S. application Ser. No. 15/647,330 filed on Jul. 12, 2017 now issued as U.S. Pat. No. 10,478,656, which claims priority to U.S. Provisional Application No. 62/361,211 filed Jul. 12, 2016. Each of the aforementioned patent applications, and any applications related thereto, is herein incorporated by reference in their entirety.

STATEMENT REGARDING FEDERALLY SPONSORED RESEARCH OR DEVELOPMENT

Not applicable to this application.

BACKGROUND

Field

The present invention relates to the field of exercise and fitness training equipment. More specifically, the improved exercise machine provides for changing exercise resistance settings by engaging more or fewer resistance biasing members using an electromagnetic clutch.

Related Art

Any discussion of the related art throughout the specification should in no way be considered as an admission that such related art is widely known or forms part of common general knowledge in the field.

Those skilled in the art will appreciate that resistance-based exercise machines provide for an exerciser to change the level or resistance as preferred for the many types of exercises that may be performed on an exercise machine. For example, the amount of resistance an exerciser would use for exercising powerful leg muscles is significantly higher than for exercising the smaller arm muscles. When performing such different exercises on a single machine, the exerciser must stop exercising, dismount the machine, change the weight or resistance settings, and remount the machine before continuing with the new and different exercise. However, this process is exceedingly disruptive to an exercise routine.

Those skilled in the art will also recognize the growing trend of performing exercises in a class environment. For instance, Pilates, one of the fastest growing forms of exercise, is routinely performed in a class setting, with dozens of exercisers performing exercises on each of their respective machines, all in unison and in response to the class trainer's instruction. A conventional Pilates machine has a movable carriage with a plurality of springs that are manually connected to the carriage to adjust the resistance applied to the carriage. Recent improvements in exercise machines with movable carriages are illustrated in U.S. Pat. Nos. 7,803,095 and 8,641,585 to Lagree which are incorporated by reference herein.

When exercises are performed in a class environment as just described, it is important that any requirement for many exercisers to simultaneously change resistance settings on the many machines necessarily minimize interruption to the exercise routine, and to minimize disruption to the exercise class as a whole. In practice, this is simply not possible using the currently available exercise machines that require the attaching or detaching multiple resistance-inducing springs from a movable exercise carriage. All exercise routines must stop to allow exercisers to change spring settings. Many newer exercisers unfamiliar with these types of machines will need one-on-one assistance from the class training instructor, further disrupting the class and delaying the resumption of the exercise routine.

Class disruption is economically costly to a commercial fitness training enterprise in two key ways: first, experienced exercisers quickly become discouraged at the disruption and delays in the routine, and oftentimes do not return, resulting in direct revenue loss; and secondly, an exercise class that could be performed in thirty minutes will take forty-five minutes or more to complete when accounting for the interruptions, thereby reducing the number of individual class sessions that can be sold to exercisers during business hours. Longer class times result in a revenue opportunity loss. Furthermore, the exerciser's tempo is disrupted by the interruptions in a manner that may affect the usefulness of the exercise program.

Therefore, those skilled in the art will immediately understand and appreciate the financial benefit and customer goodwill value of a system and method that provides for a class training instructor to instantly and simultaneously change resistance settings on all machines with no requirement of any exerciser to stop their exercise routine to individually change settings between different exercises.

SUMMARY

In view of the above, a novel exercise machine is provided. The exercise machine includes a movable carriage configured to move substantially along the length of one or more rails. A plurality of resistance biasing members are removably attachable between a stationary biasing member bracket affixed to the machine structure and the movable carriage. A controller changes the resistance settings against the movable carriage by electrically attaching or detaching any preferred number of resistance biasing members between the machine structure and movable carriage.

The various embodiments of the present invention further provide for an exercise teaching method whereby a class training instructor may change the resistance settings for each different instructed exercise on one or any number of machines by locally or remotely changing the state of one or more electromagnets of an electrical clutch that engage or disengage the biasing members.

There has thus been outlined, rather broadly, some of the embodiments of the exercise machine with electromagnetic resistance selection in order that the detailed description thereof may be better understood, and in order that the present contribution to the art may be better appreciated. There are additional embodiments of the exercise machine with electromagnetic resistance selection that will be described hereinafter and that will form the subject matter of the claims appended hereto. In this respect, before explaining at least one embodiment of the exercise machine with electromagnetic resistance selection in detail, it is to be understood that the exercise machine with electromagnetic resistance selection is not limited in its application to the details of construction or to the arrangements of the components set forth in the following description or illustrated in the drawings. The exercise machine with electromagnetic resistance selection is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Example embodiments will become more fully understood from the detailed description given herein below and the accompanying drawings, wherein like elements are represented by like reference characters, which are given by way of illustration only and thus are not limitative of the example embodiments herein.

DETAILED DESCRIPTION

A. Overview

Figure 1:
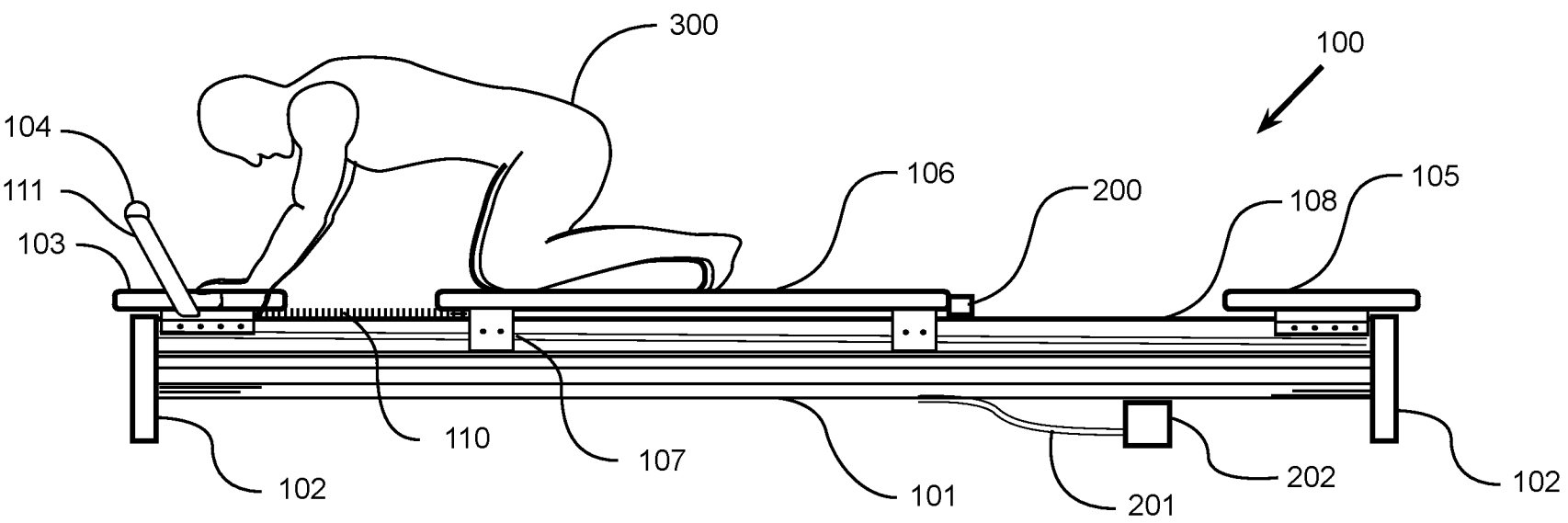
FIG. 1 is a side view of an example of an exercise machine with electromagnetic resistance selection.

An example exercise machine with electromagnetic resistance selection generally comprises a movable carriage configured to move substantially along a length of at least one trolley rail supported on a machine structure; a plurality of resistance biasing members removably attachable between a stationary biasing member bracket affixed to the machine structure and the movable carriage; and a controller configured to change a resistance setting against the movable carriage by selectively electrically attaching or detaching any number of biasing members between the biasing member bracket and the movable carriage.

Various aspects of specific embodiments are disclosed in the following description and related drawings. Alternate embodiments may be devised without departing from the spirit or the scope of the present disclosure. Additionally, well-known elements of exemplary embodiments will not be described in detail or will be omitted so as not to obscure relevant details. Further, to facilitate an understanding of the description, a discussion of several terms used herein follows.

The word "exemplary" is used herein to mean "serving as an example, instance, or illustration." Any embodiment described herein as "exemplary" is not necessarily to be construed as preferred or advantageous over other embodiments.

The phrase "biasing member" and variations thereof (e.g. resistance biasing member) are used herein to describe one or more connected components providing a mechanism for creating a preferred resistance force of an exercise machine against which an exerciser must generally apply a muscle force greater than the biasing member resistance force in order to move a component in a direction opposed to the direction of the resistance force. A biasing member may therefore incorporate a spring, an extension spring, compression spring, elastic band, a weight, a dashpot, eddy current brake, any other device capable of creating a resistance force upon the slidable carriage. The aforementioned biasing members may be connected to a cable or linkage that redirects a force of one of more resistance-inducing components to a movable component used by an exerciser for performing an exercise against the resistance.

The phrases "ferrous member" and "ferromagnetic member" are used herein to describe a ferromagnetic component affixed to a movable end of a biasing member or the movable carriage. Each ferrous member may be comprised of various ferromagnetic materials such as, but not limited to, iron, cobalt, nickel and alloys thereof, and rare earth metals. Ferrous members may be of any geometric shape or size as preferred for the application in a machine, with a magnetic field of sufficient direction and magnitude such that when magnetically coupled with a movable magnetic component, for instance, an electromagnet with an opposed field direction, such coupling is of a magnitude sufficient to extend the biasing member to a preferred length without decoupling. Further, as used herein, a ferrous member may also be a permanent magnet with a field opposed to the field created by an electromagnet as desired for coupling the permanent magnet with the electromagnet at such times that the electrical current is applied to the electromagnet.

B. Example Exercise Machine with Electromagnetic Resistance Selection

FIG. 1 is a side view of an exercise machine 100 with electromagnetic resistance selection. The exercise machine 100 includes a longitudinal structure 101 affixed to vertical support members 102 at opposed ends of the machine, a stationary front exercise platform 103 and optional push bar 104 extending substantially the width of the machine with a central axis transverse to the longitudinal axis of the machine, a back stationary platform 105 at substantially the opposed end, and a pair of parallel rails 108 extending substantially the length of the machine parallel to the longitudinal axis. A movable exercise carriage 106 is reciprocally movable upon a plurality of trolley assemblies 107 engageable with the parallel rails 108. In practice, an exerciser 300 moves the movable carriage 106 with a force in an opposed direction and equal to or exceeding the resistance force of the machine. Resistance for exercising is applied against the movable carriage by at least one biasing member 110 affixed at a first end to a stationary mounting member, and removably attached at a second end to the movable carriage.

A plurality of electromagnets (as described in more detail with reference to FIGS. 3 and 4) are mounted on an electromagnet mounting member 200, which is affixed to the movable carriage 106. The on-state and off state of the electromagnets being determined by a controller 202 in signal communication with the electromagnets. The controller 202 may communicate signals to one or more of the electromagnets via a wiring harness 201. In an alternative embodiment, the controller 202 may communicate wirelessly with the electromagnets.

Figure 2:
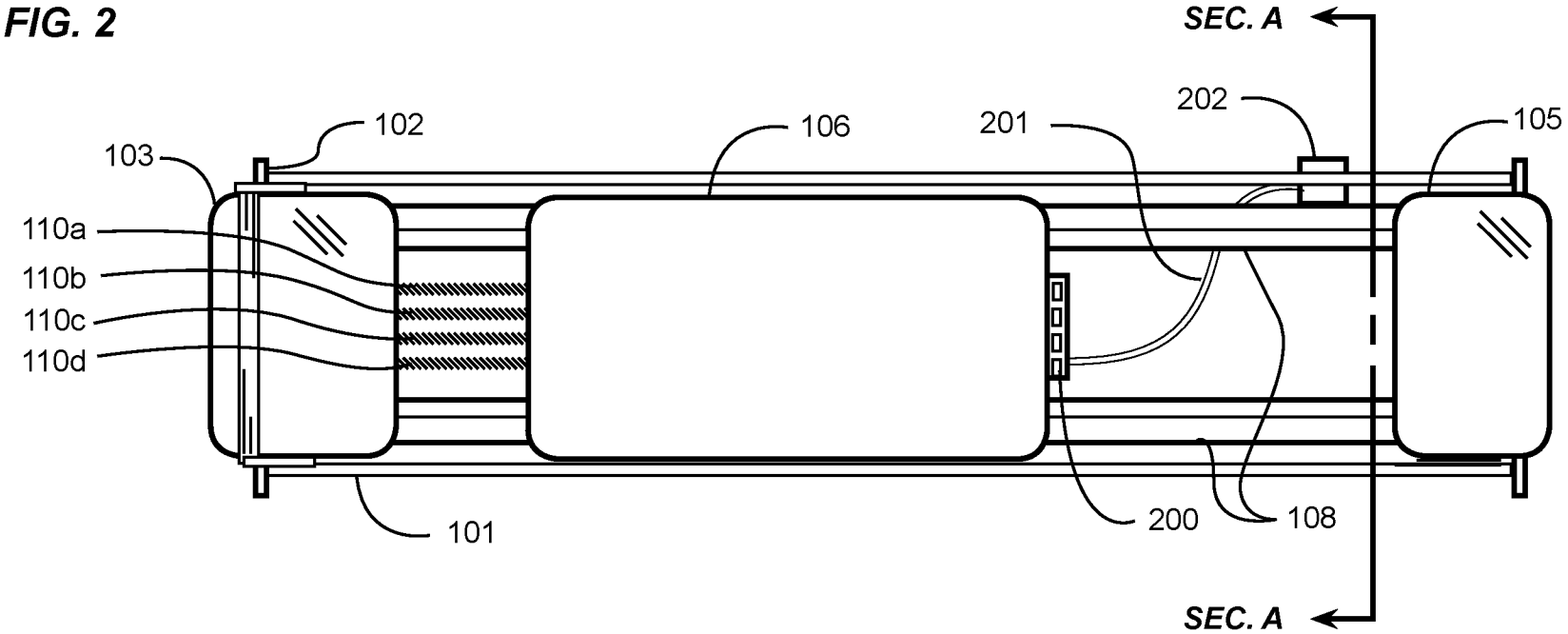
FIG. 2 is a top view of the exercise machine with electromagnetic resistance selection.

FIG. 2 is a top view of the exercise machine with electromagnetic resistance selection. The exercise machine with electromagnetic resistance selection includes vertical support members 102 at substantially opposite ends of the machine affixed to longitudinal structural members 101. These structural members further support a pair of parallel rails 108 extending substantially the length of the exercise machine. A movable carriage 106 is configured to move upon the rails 108 by the use of the plurality of trolley assemblies 107. The movable carriage 106 is movable substantially the length of the rails 108 between the stationary front platform 103 and the stationary back platform 105. FIG. 2 illustrates the exercise machine as having biasing members 110*a*, 110*b*, 110*c*, 110*d* removably attachable between the stationary support structure and the movable carriage 106 to provide for exercise resistance to be applied against the movable carriage 106. The electromagnet mounting member 200 is affixed to one portion of the movable carriage 106. The electromagnet mounting member 200 provides for retention of one or more electromagnets not shown in FIG. 2. The one or more electromagnets are in signal communication with the controller 202 via the wiring harness 201.

It is noted that each of the biasing members 110 may be identical in terms of the resistance force each member may apply to the movable carriage 106 when the length of the biasing member 110 is extended from its starting length. Alternatively, each biasing member 110 may deliver varying resistance forces against the movable carriage 106 to which the biasing members 110 are attached.

In an example implementation, the four biasing members 110 shown in FIG. 2 may include a first biasing member 110*a* configured to deliver a resistance equivalent to ten pounds of force, a second member 110*b* configured to deliver the equivalent of twenty pounds of force, a third member 110*c* configured to deliver the equivalent of forty pounds of force, and a fourth member 110*d* configured to deliver the equivalent of sixty pounds of force. By selecting different combinations of the biasing members 110, the total resistance force applied to the movable carriage 106 may range from ten pounds to one hundred thirty pounds (as described below with reference to FIG. 12). The controller 202 may also send Off-State signals to all of the electromagnets so that no added resistance force is applied to the movable carriage 106. A sectional view SEC. A from the back of the machine as shown in FIG. 2 is subsequently illustrated in FIG. 4.

Figure 3:
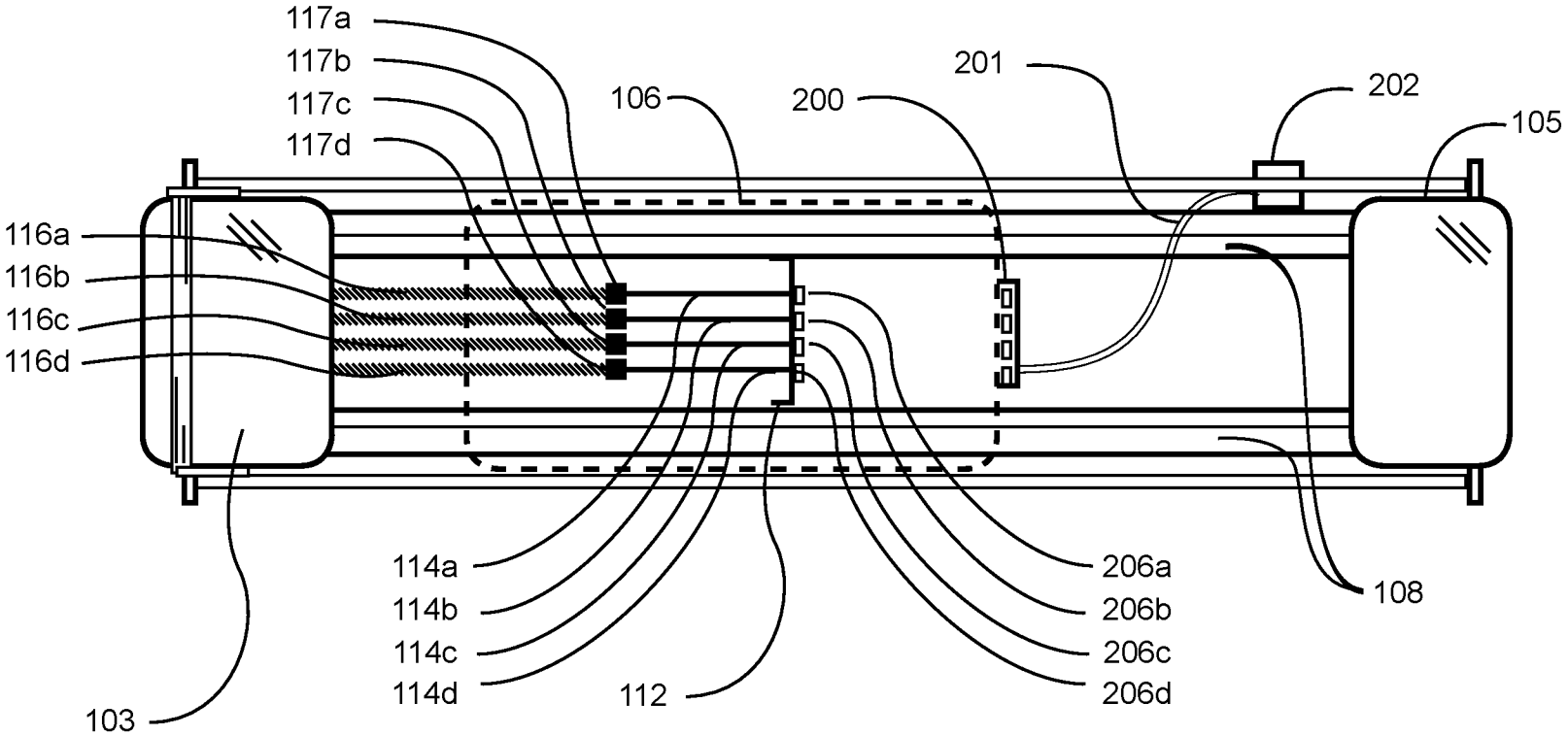
FIG. 3 is a top view of the exercise machine with electromagnetic resistance selection with the movable carriage removed.

FIG. 3 is a top view of the exercise machine with electromagnetic resistance selection with the movable carriage removed and shown as a dashed outline labelled with reference number 106 to illustrate operational components of the exercise machine otherwise obscured by the movable carriage 106.

As previously described, the movable carriage 106 (as shown in FIG. 1) rolls substantially the length of the pair of rails 108 between the stationary front platform 103 and the stationary back platform 105. A biasing member bracket 112 extending substantially between, transverse to and affixed near the rails 108 is configured to retain the movable ends of the plurality of biasing members 110 not actuated to provide resistance on the movable carriage 106.

Each biasing member 110*a*, 110*b*, 110*c*, 110*d* (as shown in FIG. 2) may comprise a corresponding extendible member 116*a*, 116*b*, 116*c*, 116*d* such as, for example, a spring affixed at one end to the exercise machine near the stationary front platform, a corresponding tension cable 114*a*, 114*b*, 114*c*, 114*d*, a corresponding coupling 117*a*, 117*b*, 117*c*, 117*d* connecting the extendible member with the first end of the tension cable 114*a*, 114*b*, 114*c*, 114*d*, and a corresponding ferrous member 206*a*, 206*b*, 206*c*, 206*d* affixed to the second end of the tension cable 114*a*, 114*b*, 114*c*, 114*d*. The biasing member bracket 112 retains the biasing members by providing for an opening, such as a slot or hole, through which the tension cable 114*a*, 114*b*, 114*c*, 114*d* may be pulled through. The opening may have an opening dimension smaller than the dimension of the ferrous member 206*a*, 206*b*, 206*c*, or 206*d* so that the ferrous member 206*a*, 206*b*, 206*c*, or 206*d* is pulled by the extendible member 116*a*, 116*b*, 116*c*, or 116*d* against the distal surface of the biasing member bracket 112, but no further. The ferrous members 206*a*, 206*b*, 206*c*, 206*d* in FIG. 3 are shown in an inactive position since none of the ferrous members 206*a*, 206*b*, 206*c*, 206*d* are magnetically coupled with any of the electromagnets on the electromagnet mounting member 200 affixed to the movable carriage 106. A plurality of electromagnets affixed to the electromagnet mounting member 200 may be actuated by signals received from the controller 202 over the wiring harness 201.

Figure 4:
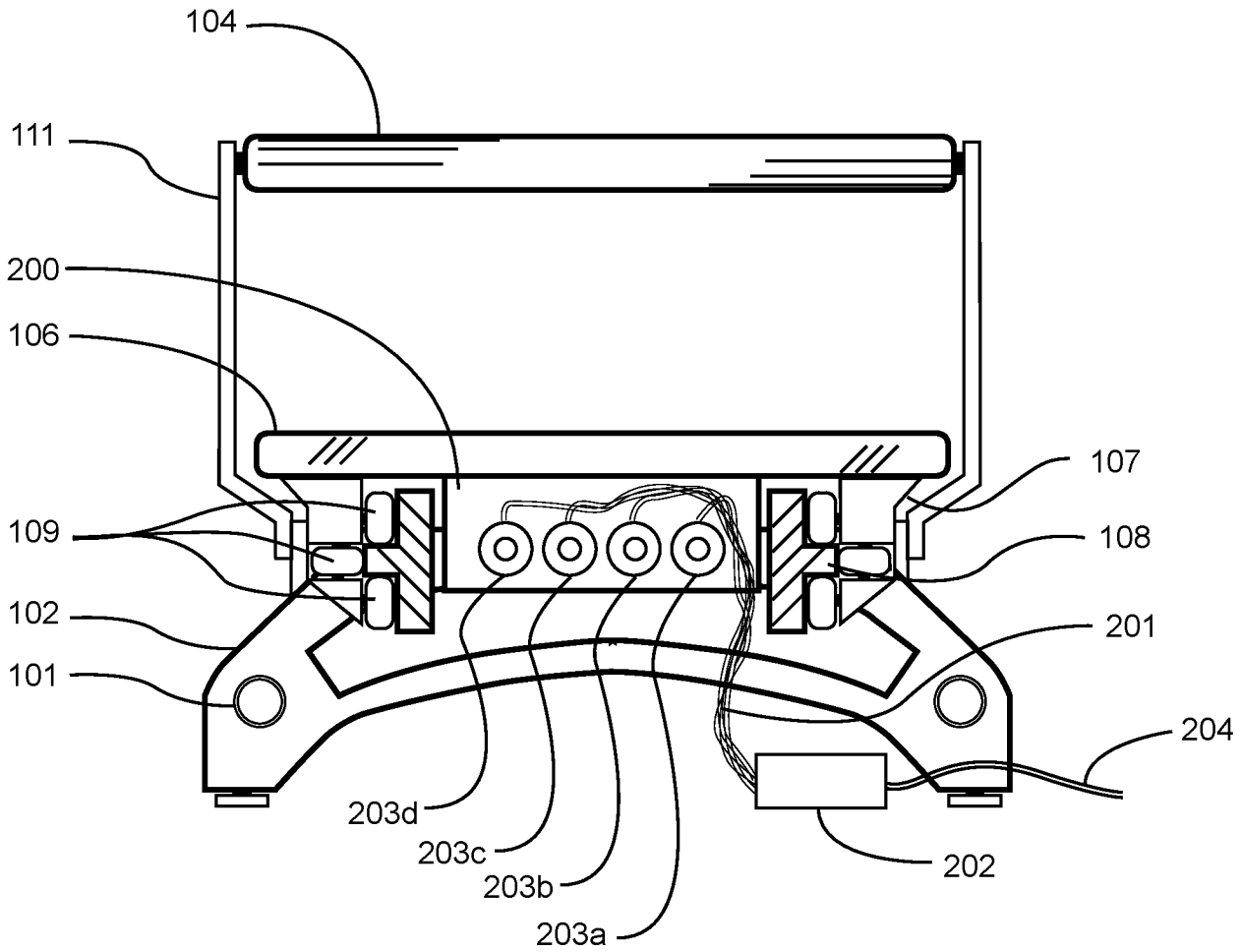
FIG. 4 is a back view through a section of the exercise machine with electromagnetic resistance selection.

FIG. 4 is a back view through a section of the exercise machine with electromagnetic resistance selection when looking from the distal end of the exercise machine towards the proximal end. The proximal or front end includes in part a push bar 104 supported by a right and left push bar stanchion 111, the right and left stanchions 111 being substantially mirror images of one another. As shown in FIG. 4, the electromagnet mounting member 200 is attached to the back-end edge of the movable carriage 106. A plurality of electromagnets 203*a*, 203*b*, 203*c*, 203*d* are mounted in the electromagnet mounting member 200. The electromagnets 203*a*, 203*b*, 203*c*, 203*d* are in signal communication with the controller 202 over the wiring harness 201 and the controller 202 is connected to a power source via a power cord 204.

The lower structure of the exercise machine includes a plurality of vertical support members 102 and a left and right longitudinal structural member 101. The pair of parallel rails 108 extends longitudinally substantially the length of the exercise machine. The rails 108 provide for running surfaces for the plurality of trolley assemblies 107, which are affixed substantially to the underside surface of the movable carriage 106. Each trolley assembly 107 includes three trolley wheels 109 mounted so as to restrict unwanted vertical and lateral movement while providing unrestricted longitudinal movement of the movable carriage 106.

Figure 5:
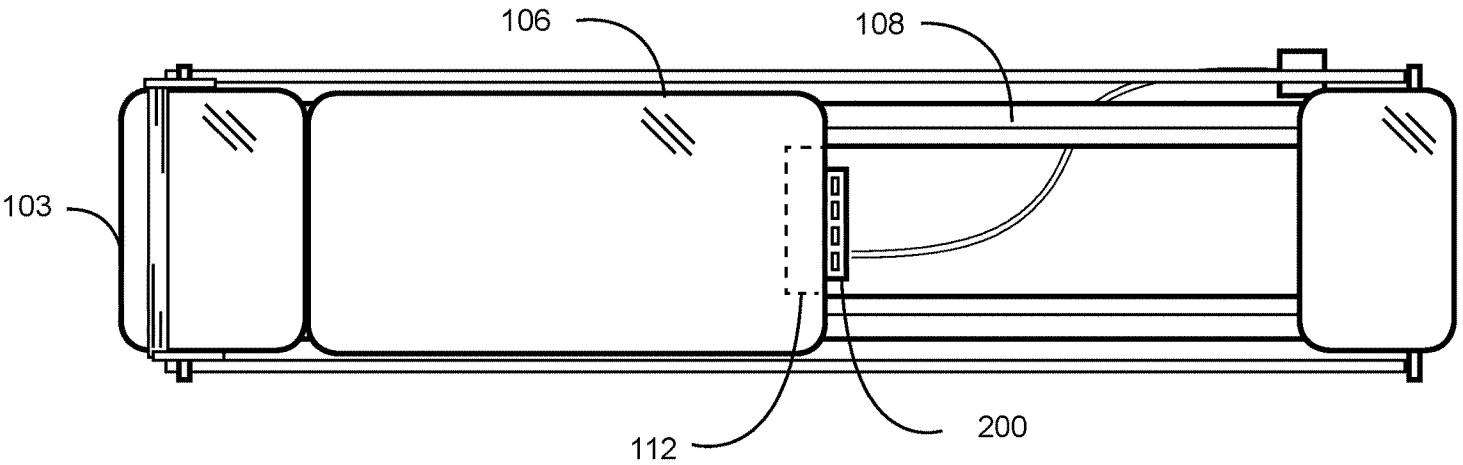
FIG. 5 is a top view of the exercise machine with electromagnetic resistance selection with the movable carriage at a zero position.

FIG. 5 is a top view of the exercise machine with electromagnetic resistance selection where the movable carriage 106 is positioned at a first position at the proximal end of the exercise machine. The first position shall be hereinafter referred to as a zero position to indicate that the zero position limits the movable carriage 106 from further movement in the proximal direction. At the zero position of the exercise machine, the movable carriage 106 is positioned proximate to the stationary front platform 103. The zero position also locates the electromagnet mounting member 200 proximate to the biasing member bracket 112 (shown as a dashed line since it is positioned vertically below the movable carriage 106). During exercise, the movable carriage 106 may roll substantially the exposed length of the parallel rails 108.

Figure 6:
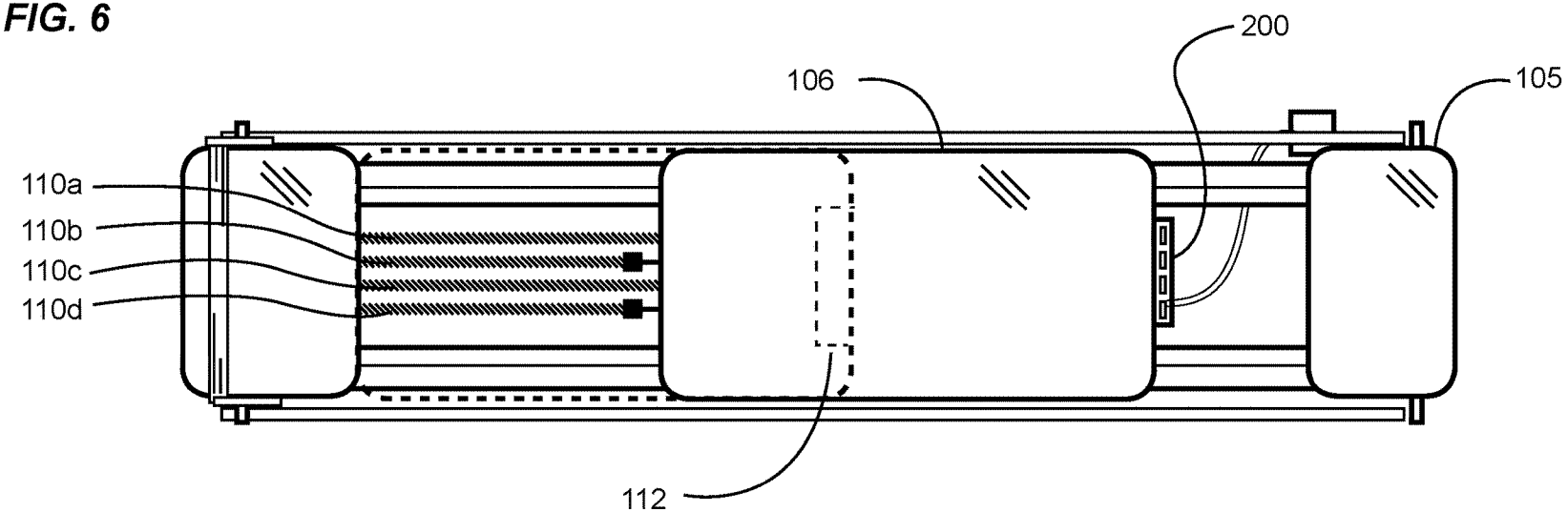
FIG. 6 is a top view of the exercise machine with electromagnetic resistance selection with the movable carriage at an extended position.

FIG. 6 is a top view of the exercise machine with electromagnetic resistance selection with the movable carriage 106 at an extended position in the distal direction. As shown in FIG. 6, the movable carriage 106 has been moved along the rails 108 (shown in FIG. 5) towards the stationary back platform 105 to the illustrated extended position. The zero position is illustrated in FIG. 6 by the dashed outline of the movable carriage. Concurrently, the electromagnet mounting member 200 affixed to the movable carriage 106 has also been moved to a new position distal to the biasing member bracket 112 (shown as a dashed line since it is in a fixed position relative to the movable carriage 106). The exercise machine illustrated in FIGS. 5 and 6 provides for, but is not limited to, four biasing members 110*a*, 110*b*, 110*c*, 110*d*. Two or more biasing members 110 may be used in example implementations.

Figure 7:
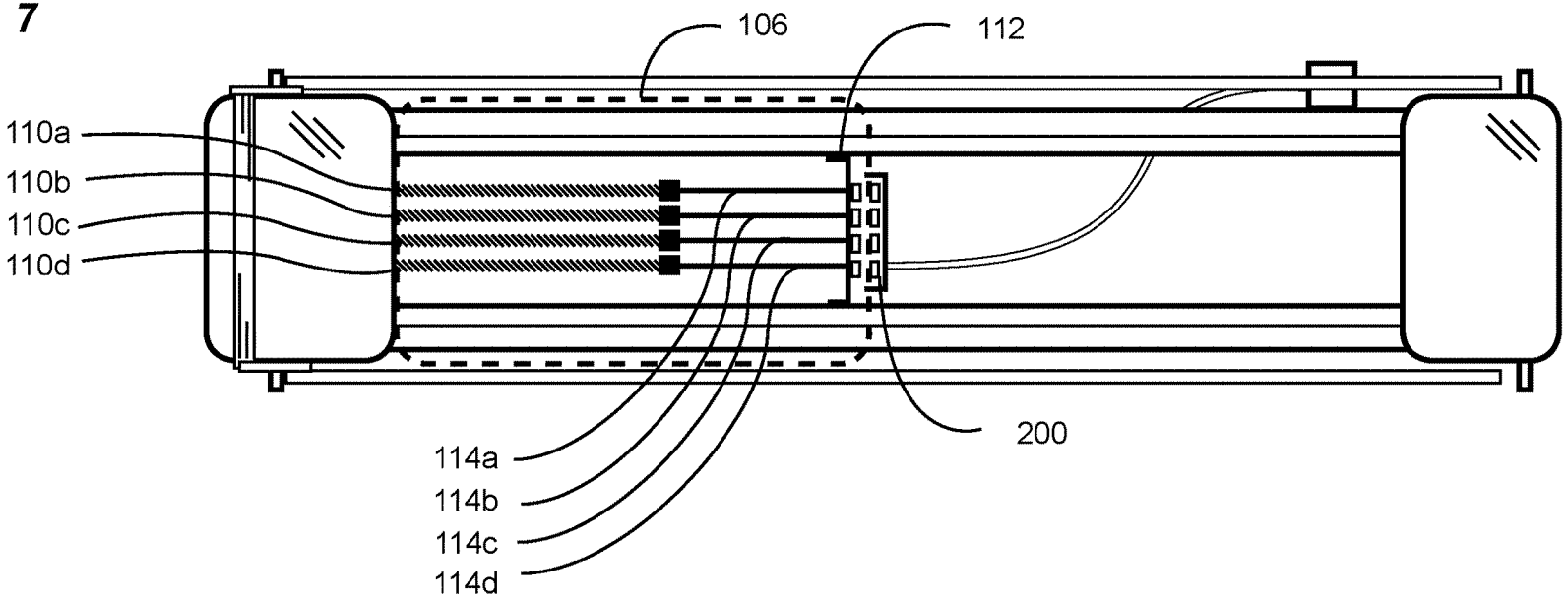
FIG. 7 is a top view of the exercise machine with electromagnetic resistance selection with the outline of a movable carriage at a zero position.

FIG. 7 is a top view of the exercise machine with electromagnetic resistance selection with the outline of the movable carriage 106 at the zero position. The plurality of biasing members 110*a*, 110*b*, 110*c*, 110*d* are affixed at one end to a stationary mounting member (described below with reference to FIG. 9A) substantially at the front end of the exercise machine. The opposite ends of the biasing members 110*a*, 110*b*, 110*c*, 110*d* include respective cables 114*a*, 114*b*, 114*c*, 114*d*, which comprise the non-elastic end of the biasing members 110*a*, 110*b*, 110*c*, 110*d*, which are terminated with corresponding ferrous members as described above with reference to FIG. 3). The ferrous members allow for retention of the cables 114*a*, 114*b*, 114*c*, 114*d* in the biasing member bracket 112. In the zero position, the biasing member bracket 112 is proximate to the electromagnet mounting bracket 200, which is affixed to the movable carriage 106.

Figure 8:
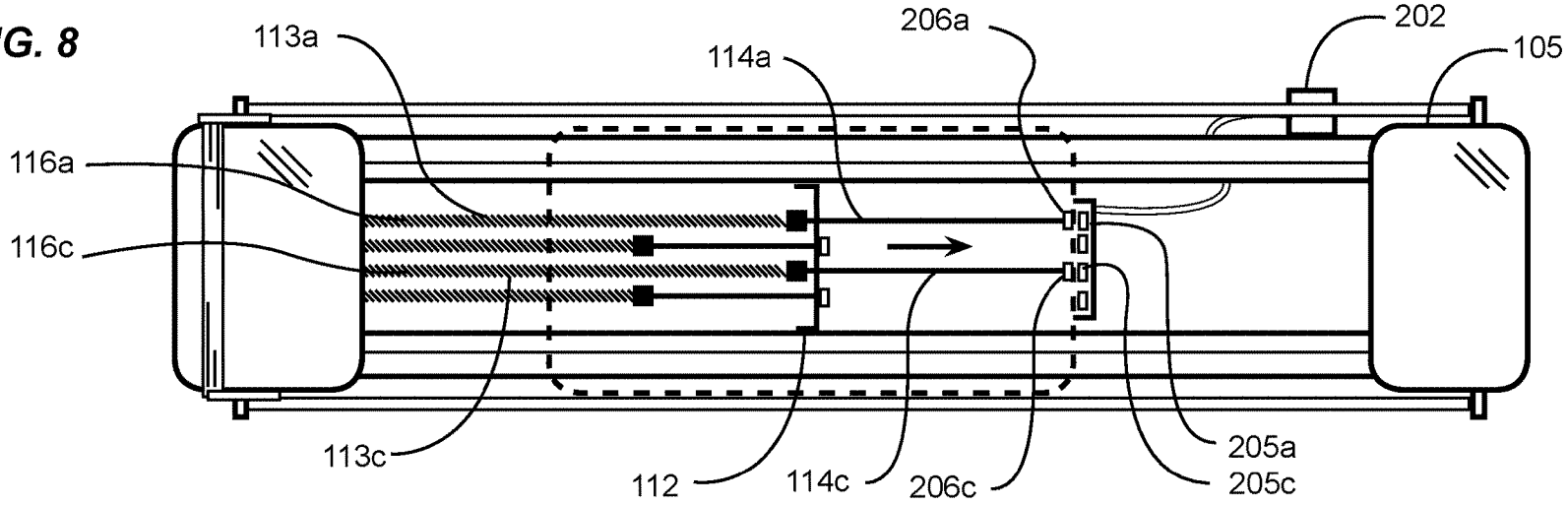
FIG. 8 is a top view of the exercise machine with electromagnetic resistance selection with the outline of a movable carriage at an extended position.

FIG. 8 is a top view of the exercise machine with electromagnetic resistance selection with the outline of the movable carriage 106 at an extended position. In practice, one example of applying resistance to the movable carriage 106 provides for communicating signals to the controller 202 to electrically actuate two electromagnets 203*a*, 203*c*, turning them to an on-state to enable magnetic coupling with the corresponding ferrous members 206*a*, 206*c* proximate to the on-state electromagnets. The magnetically coupled ferrous members 206*a*, 206*c* are connected to respective cables 114*a*, 114*c*, and correspondingly the cables 114*a*, 114*c* are affixed to the extendable members 116*a*, 116*c*. The extendable members 116*a*, 116*c* draw the cables 114*a*, 114*c* through the biasing member bracket 112 as the movable carriage 106 is moved in a direction towards the stationary back platform 105, thereby applying a resistance force equal to the two magnetically coupled extendable members 116*a*, 116*c* against the movable carriage 106. The movement of the movable carriage 106 creates a condition whereby the biasing members 110*a*, 110*c* become extended biasing members 113*a*, 113*c* as shown in FIG. 8.

Figure 9A:
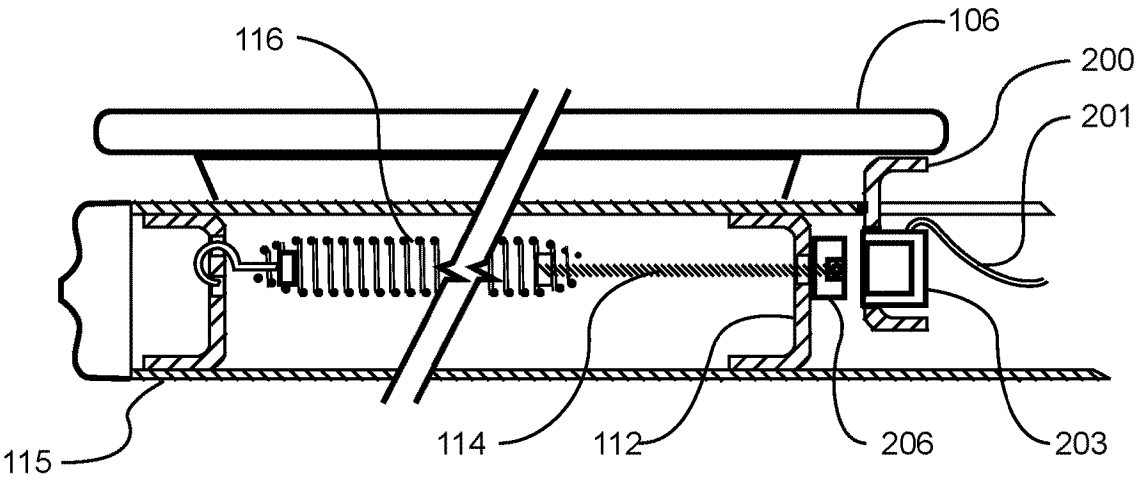
FIG. 9A is a side section view of the electronic resistance system in a zero state.

FIG. 9A is a side section view of the electronic resistance system in a zero state. As shown in FIG. 9A, an extendable member 116 is affixed at one end to the stationary mounting member 115. It is noted that an extendable member may be an extension spring, or elastic band, or elastic cord, or similar extendable component that provides for increasing resistance correlating to an increased length of the component. A first end of the cable 114 is affixed to the movable end of the extendable member 116, with the second end passing through the biasing member bracket 112. The biasing member bracket 112 temporarily retains the ferrous members 206 in a position proximate to corresponding electromagnets 203 for magnetic coupling. A plurality of electromagnets 203 are affixed to the electromagnet mounting member 200 attached to the movable carriage 106. The electromagnets 203 may be in periodic communication with the controller (not shown in FIG. 9A) via the wiring harness 201.

In an example implementation, the controller 202 is configured to inhibit the changing of any of the electromagnet states unless and until the movable carriage 106 is at the zero position, when the plurality of ferrous members 206 are positioned in their zero positions within the biasing member bracket 112, and when the electromagnets 203 are proximate to the ferrous members 206.

At the zero position, the state of any electromagnet may be changed by controller signals, providing for instant coupling or decoupling of any preferred biasing members.

Figure 9B:
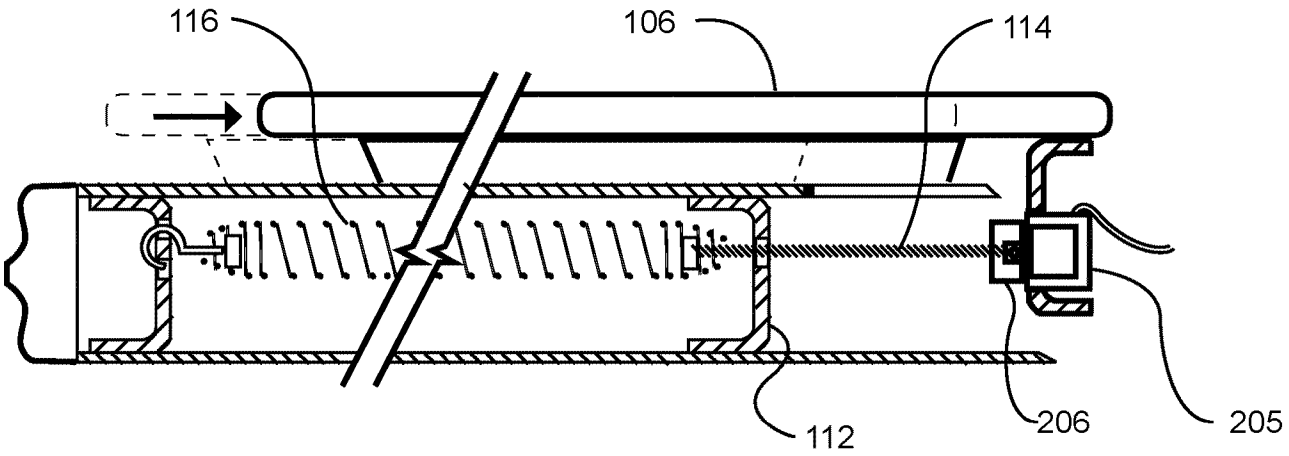
FIG. 9B is a side section view of the electronic resistance system in an on-state.

FIG. 9B is a side section view of the electronic resistance system in an on-state. In practice, an electromagnet 203 receives a power signal from the controller 202 (see FIG. 3), which may turn the electromagnet 203 from an off-state to an on-state. The on-state causes the electromagnet 203 to couple with the proximate ferrous member 206 which, when pulled by the electromagnet 203 by movement of the movable carriage 106, pulls the fixed length tension cable 114 through the biasing member bracket 112, and correspondingly lengthens the extendable member 116, thereby providing a resistance force against the movable carriage 106.

C. Example Electronic Resistance System

Figure 10:
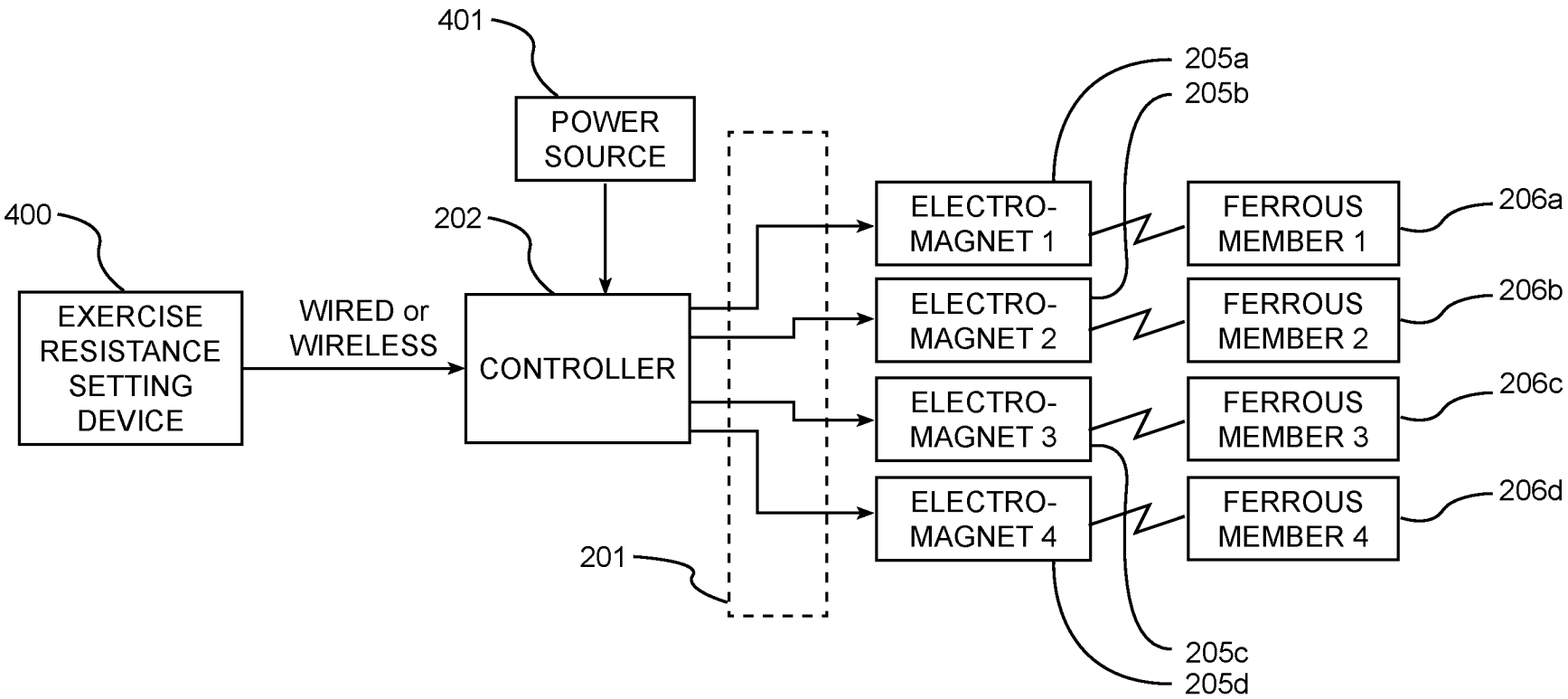
FIG. 10 is a block diagram of an electronic resistance system.

FIG. 10 is a block diagram of an electronic resistance system. The exercise machine with electromagnetic resistance selection provides for a plurality of resistance biasing members and a method of coupling the biasing member to a movable carriage. As described above with reference to FIGS. 6-8, the ferrous members 206*a*, 206*b*, 206*c*, 206*d* are affixed to the terminal end of each biasing member. The ferrous members 206*a*, 206*b*, 206*c*, 206*d* may be coupled with their respective on-state electromagnets 203*a*, 203*b*, 203*c*, 203*d* in response to signals received from a controller 202 through the wiring harness 201. Signals may be sent from an exercise resistance setting device 400 to the controller 202. The signals indicate which of the electromagnets 203*a*, 203*b*, 203*c*, 203*d* are to be state-changed, whether it be from on to oft off to on, or no change. The communication between the resistance setting device 400 and the controller 202 may be wired or wireless (using any suitable wireless infrastructure, such as for example, WiFi, Bluetooth™, etc.). The resistance setting device 400 may be located upon or proximate to the exercise machine, or remotely. The exercise machine uses a power source 401 with a suitable voltage and amperage output as is necessary to change and maintain the on-state of all electromagnets 203 for the duration of time that the on-state of the selected electromagnets 203 remain in the on-state.

It is noted that although FIG. 10 shows four electromagnets 203 corresponding to four ferrous member 206, which correspond to four resistance biasing members (not shown), other example implementations of the exercise machine need not be limited to four biasing members (and corresponding electromagnets and ferrous members). Other example implementations may have any suitable number of biasing members providing for similar or different resistance forces.

It is further noted that the exercise resistance setting device 400 may be operable by the exerciser upon the exercise machine, or by a training instructor who is instructing the exerciser.

Figure 11:
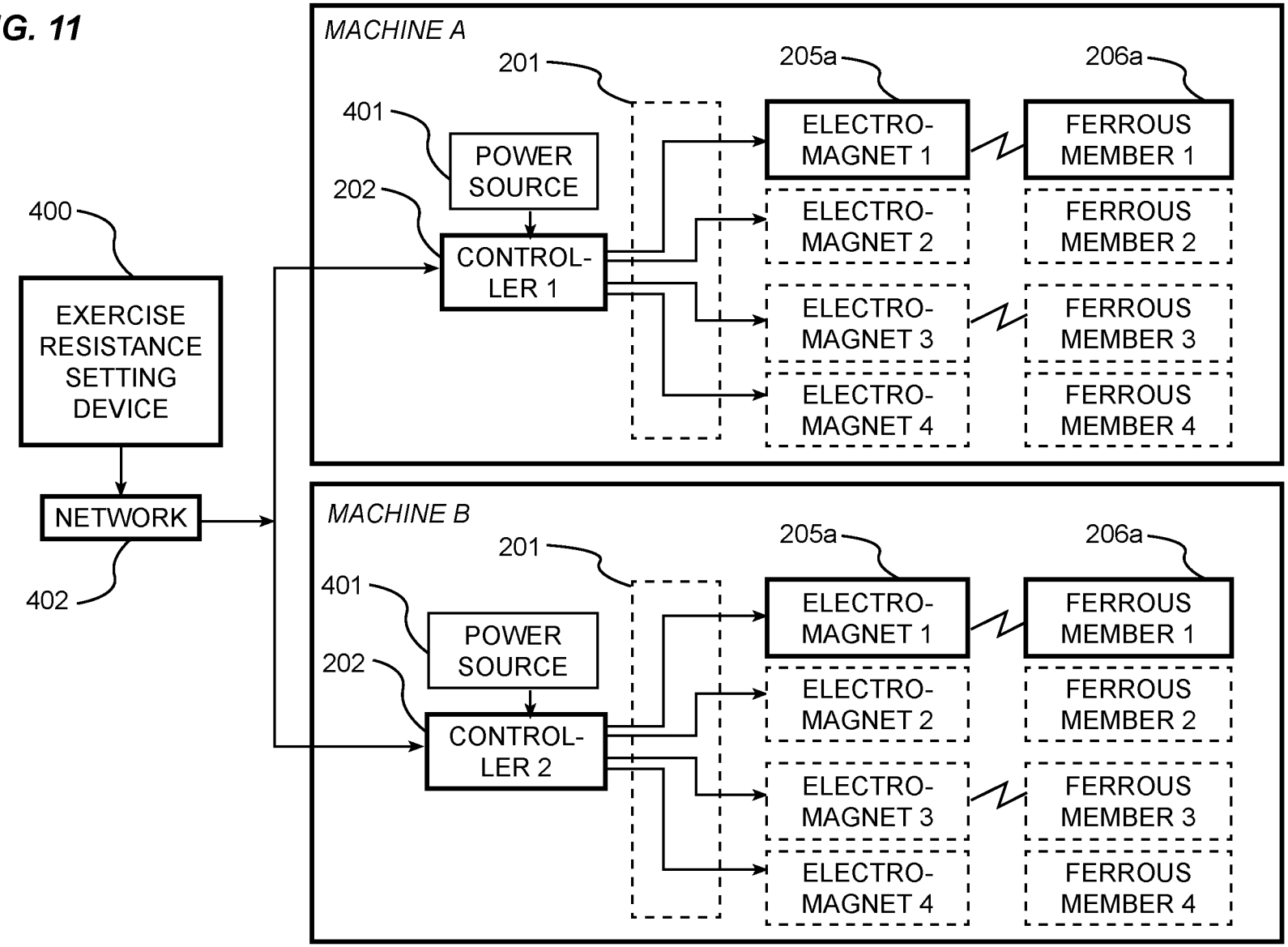
FIG. 11 is a block diagram of multiple exercise machines with electronic resistance systems connected through a network.

FIG. 11 is a block diagram of multiple exercise machines with electronic resistance systems connected through a network 402. It may be desirable for an instructor in a class of exercisers performing exercises on individual exercise machines to simultaneously control or change the resistance level on all exercise machines as preferred for each of the many different exercises that may be performed on the machines during a workout routine. FIG. 11 illustrates, as one example, two exercise machines representative of any number of exercise machines greater than one that are being used simultaneously during an exercise class. Each exercise machine A or B provides for an equal number of ferrous members 206 affixed to the terminal end of each corresponding biasing member. The same ferrous members 206 on each of the plurality of exercise machines may be simultaneously coupled or uncoupled from their respective electromagnets 203 in response to signals received from their corresponding controllers 202 through their corresponding wiring harness 201.

FIG. 11 illustrates signals sent from the exercise resistance setting device 400 to the controllers 202. The signals indicate which of the electromagnets (203*a* in machines A and B in FIG. 11) are to be state-changed, that being from on to oft off to on, or no change. An instructor may use the exercise resistance setting device 400, which is in wired or wireless communication with the network 402. The signals may be communicated wirelessly or via wires to controllers 202 on the exercise machines A and B. Each exercise machine is provided with a power source 401 of the preferred voltage and amperage as necessary to change and maintain the on-state of all electromagnets for the duration of time that the on-state of the preferred number of electromagnets remain in the on-state. The previously described control units convert the communication from the exercise class resistance setting device 400 to power signals, communicating those signals via wiring harnesses 201 to each of the electromagnets 203 that are preferably changed to an on-state.

In the example illustrated in FIG. 11, the instant instructions from the exercise class resistance setting device 400 change the state of all electromagnets 203*a* similarly configured on exercise machines A and B in the class so that all such electromagnets are changed to an on-state. The electromagnets 203*a* correspondingly magnetically couple with ferrous members 206*a*, thereby simultaneously engaging their corresponding biasing members on the exercise machines A and B in the exercise class.

Figure 12:
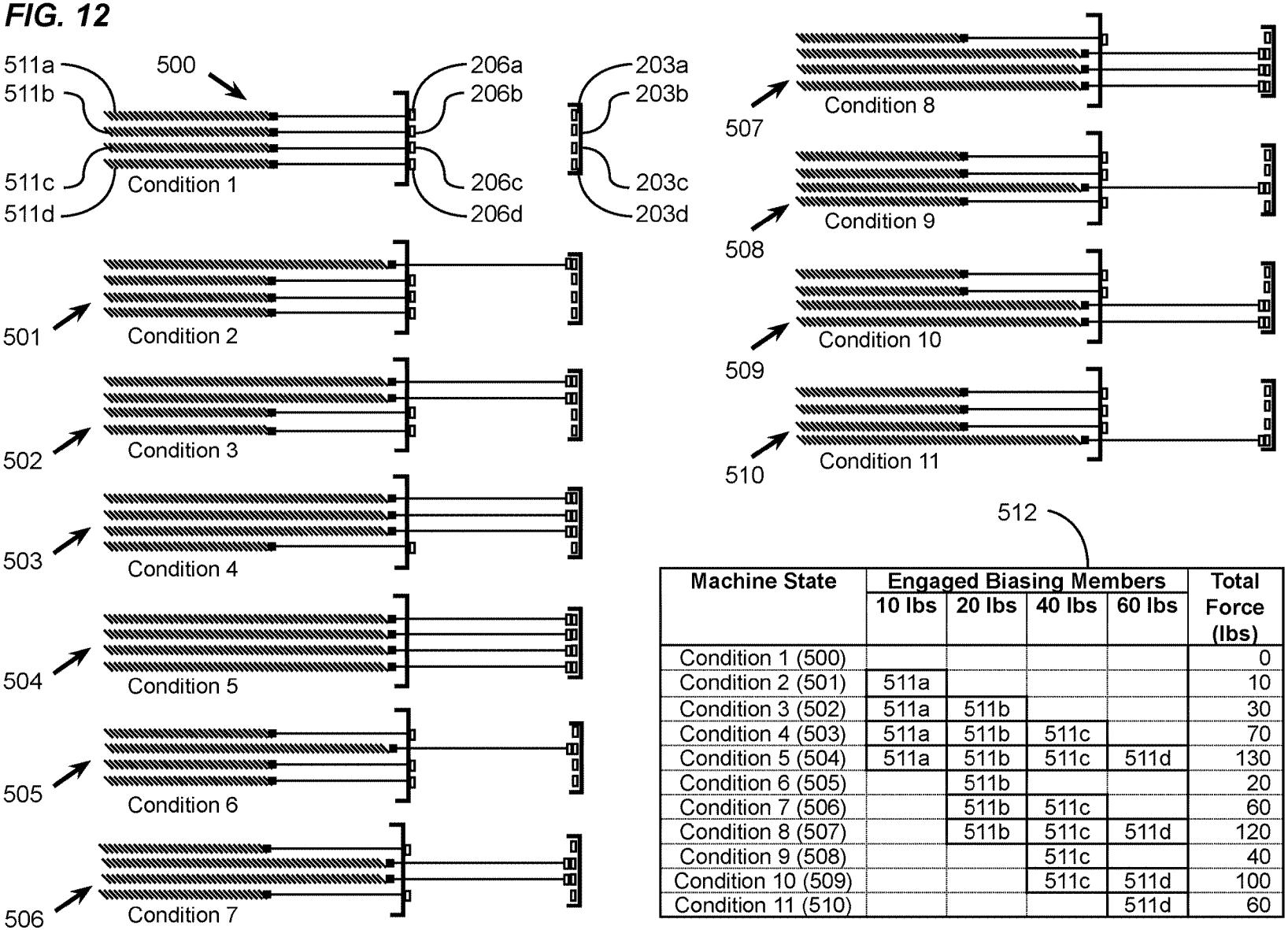
FIG. 12 is a schematic diagram showing a force selection table and variations of machine settings of different biasing members to achieve preferred machine resistance settings in an example implementation.

FIG. 12 is a schematic diagram showing a force selection table 512 and variations of machine settings 500-510 for different combinations of engaged biasing members 511 to achieve selected exercise machine resistance settings in an example implementation. The force selection table 512 defines various on-state, off-state settings of different electromagnets 203 to couple with corresponding biasing members to achieve the preferred total machine resistance setting. As previously described, one example exercise machine with electromagnetic resistance selection provides for four biasing members. In FIG. 12, each biasing member 511*a*, 511*b*, 511*c*, 511*d* (in FIG. 7) provides for different resistance forces with a first biasing member 511*a* being preferably a ten-pound spring, a second biasing member 511*b* being preferably a twenty pound spring, a third biasing member 511*c* being preferably a forty pound spring, and a forth biasing member 511*d* being preferably a sixty pound spring.

Since the structural elements of the exercise machine with electromagnetic resistance selection described above would distract from the objective of illustrating the various on-state, off-state conditions of the various biasing members to establish the selected machine resistance settings, they are not shown.

Referring to FIG. 12, in Condition 1 500, none of the electromagnets 203*a*, 203*b*. 203*c*. 203*d* have been charged to the on-state. Therefore, none of the electromagnets 203*a*, 203*b*. 203*c*. 203*d* magnetically couple with any corresponding ferrous members 206*a*, 206*b*, 206*c*, 206*d* of the biasing members 511*a*, 511*b*, 511*c*, 511*d*.

In the following descriptions, for purposes of clarity, the reference numbers and lines corresponding to the biasing members, ferrous members and electromagnets have not been repeated for all conditions, however the reference lines and numbers shown in Condition 1 500 apply to all subsequent descriptions of the various conditions., and are referenced in the description as if the reference numbers and lines appeared on the drawing for each Condition.

In Condition 2 501, one electromagnet 203*a*, having been charged to the on-state, couples with a ferrous member 206*a* of a first biasing member 511*a*.

In Condition 3 502, two of the electromagnets 203*a*, 203*b* having been charged to the on-state couple with the corresponding ferrous members 206*a*, 206*b* of each corresponding biasing member 511*a*, 511*b*.

In Condition 4 503, three of the electromagnets 203*a*, 203*b*, 203*c* having been charged to the on-state couple with the corresponding ferrous members 206*a*, 206*b*, 206*c* of each corresponding biasing member 511*a*, 511*b*, 511*c*.

In Condition 5 504, four of the electromagnets 203*a*, 203*b*, 203*c*, 203*d* having been charged to the on-state couple with the corresponding ferrous members 206*a*, 206*b*, 206*c*, 206*d* of each corresponding biasing member 511*a*, 511*b*, 511*c*, 511*d*.

In Condition 6 505, one of the electromagnets 203*b* having been charged to the on-state couple with the corresponding ferrous member 206*b* of the corresponding biasing member 511*b*.

In Condition 7 506, two of the electromagnets 203*b*, 203*c* having been charged to the on-state couple with the corresponding ferrous members 206*b*, 206*c* of each corresponding biasing member 511*b*, 511*c*.

In Condition 8 507, three of the electromagnets 203*b*, 203*c*, 203*d* having been charged to the on-state couple with the corresponding ferrous members 206*b*, 206*c*, 206*d* of each corresponding biasing member 511*b*, 511*c*, 511*d*.

In Condition 9 508, one electromagnet 203*c* having been charged to the on-state couples with the corresponding ferrous member 206*c* of the corresponding biasing member 511*c*.

In Condition 10 509, two of the electromagnets 203*c*, 203*d* having been charged to the on-state couple with the corresponding ferrous members 206*c*, 206*d* of each corresponding biasing member 511*c*, 511*d*.

In Condition 11 510, one of the electromagnets 203*d* having been charged to the on-state couple with the corresponding ferrous member 206*d* of the corresponding biasing member 511*d*.

In the example illustrated in FIG. 12, the discrete resistance forces of the various biasing members, and the various combinations of biasing members that may be coupled with the various electromagnets, and the range of possible unitary and combined resistance settings for the exemplary machine are shown in the force selection table 512.

FIGS. 1 through 9B illustrate an exemplary exercise machine including a frame having at least one rail having a longitudinal axis, a first end, a second end, a first end platform connected to the frame near the first end of the frame, and a second end platform connected to the frame near the second end of the frame. A carriage is movably connected to the at least one rail and is adapted to be movable along a portion of the at least one rail. A plurality of biasing members are provided wherein each of the biasing members has a first end connected to the frame and a second end opposite of the first end.

A plurality of first magnetic members are further provided wherein each of the first magnetic members are connected to the second end of a corresponding biasing member. A plurality of second magnetic members are further provided that are connected to the carriage directly or indirectly (e.g. via a mounting bracket). Each of the second magnetic members corresponds with one of the first magnetic members forming a magnetically attractable pair of connectors to allow for selective engagement of the biasing members with the carriage to control the total amount of resistance force applied to the carriage when moved in a first direction.

The plurality of first magnetic members are each preferably aligned with the plurality of second magnetic members. A bracket may be connected to the frame that is adapted to support the plurality of biasing members not engaged with the carriage. The bracket may include a plurality of openings, wherein the second end of each of the plurality of biasing members extend through a corresponding opening.

A controller is electrically connected to the first magnetic members or the second magnetic members. The controller is configured to actuate one or more of the first magnetic members or the second magnetic members to magnetically couple one or more of the first magnetic members to a corresponding second magnetic member to control a resistance force applied to the carriage.

The carriage is movable between a first position and a second position, wherein when the carriage is in the first position the first magnetic members are positioned proximate the corresponding second magnetic members sufficient to allow for magnetic connection of corresponding magnetic members when actuated by the controller. The controller is preferably configured to prevent any switching of any magnetic member to an off-state when the movable carriage is not in the first position.

In one embodiment, the first magnetic members may be comprised of a ferromagnetic material (e.g. ferrous material or permanent magnet) and the second magnetic members may be comprised of electromagnets. In this arrangement, the controller is electrically connected to the second magnetic members to selectively magnetically connect to the first magnetic members.

In another embodiment, the second magnetic members may be comprised of a ferromagnetic material (e.g. ferrous material or permanent magnet) and the first magnetic members may be comprised of electromagnets. In this arrangement, the controller is electrically connected to the first magnetic members to selectively magnetically connect to the second magnetic members.

Although specific embodiments have been illustrated and described herein, it will be appreciated by those of ordinary skill in the art that a wide variety of alternate and/or equivalent implementations may be substituted for the specific embodiments shown and described without departing from the scope of the present disclosure. This application is intended to cover any adaptations or variations of the embodiments discussed herein.

Unless otherwise defined, all technical and scientific terms used herein have the same meaning as commonly understood by one of ordinary skill in the art to which this invention belongs. Although methods and materials similar to or equivalent to those described herein can be used in the practice or testing of the exercise machine with electromagnetic resistance selection, suitable methods and materials are described above. All publications, patent applications, patents, and other references mentioned herein are incorporated by reference in their entirety to the extent allowed by applicable law and regulations. The exercise machine with electromagnetic resistance selection may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

What is claimed is:

1. An exercise machine comprising:

a frame having at least one rail;

a carriage movably connected to the at least one rail, wherein the carriage is adapted to be movable along a portion of the at least one rail;

a plurality of biasing members;

a plurality of ferromagnetic members, wherein each of the plurality of ferromagnetic members are connected to a corresponding biasing member of the plurality of biasing members;

a plurality of electromagnets connected to the carriage, wherein each of the plurality of electromagnets corresponds with one of the plurality of ferromagnetic members; and a controller electrically connected to the plurality of electromagnets, wherein the controller is configured to actuate one or more of the plurality of electromagnets to magnetically couple one or more of the plurality of electromagnets to a corresponding ferromagnetic member of the plurality of ferromagnetic members to control a resistance force applied to the carriage.

2. The exercise machine of claim 1, wherein the carriage is movable between a first position and a second position, wherein when the carriage is in the first position the plurality of electromagnets are positioned near the plurality of ferromagnetic members.

3. The exercise machine of claim 2, wherein the controller is configured to prevent any switching of any of the plurality of electromagnets to an off-state when the carriage is not in the first position.

4. A method of operating the exercise machine of claim 1, the method comprising:

selecting one or more biasing members from the plurality of biasing members on the exercise machine to engage with the carriage; and sending an on-state signal to selected electromagnets of the plurality of electromagnets to magnetically activate the selected electromagnets, wherein the selected electromagnets correspond to the selected biasing members of the plurality of biasing members.

5. The method of claim 4, including the step of sending an off-state signal to unselected electromagnets of the plurality of electromagnets to magnetically uncouple the unselected electromagnets from corresponding ferromagnetic members of the plurality of ferromagnetic members.

6. The exercise machine of claim 1, wherein the plurality of ferromagnetic members are each comprised of a ferrous material, a ferromagnetic material, or a permanent magnet.

7. The exercise machine of claim 1, wherein the plurality of electromagnets are connected to a mounting bracket affixed to the carriage.

8. The exercise machine of claim 1, wherein the plurality of ferromagnetic members are each aligned with the plurality of electromagnets.

9. The exercise machine of claim 1, including a first end platform connected to the frame near a first end of the frame and a second end platform connected to the frame near a second end of the frame.

10. An exercise machine comprising:

a frame having at least one rail;

a carriage movably connected to the at least one rail, wherein the carriage is adapted to be movable along a portion of the at least one rail;

a plurality of biasing members;

a plurality of electromagnets, wherein each of the plurality of electromagnets are connected to a corresponding biasing member of the plurality of biasing members;

a plurality of ferromagnetic members connected to the carriage, wherein each of the plurality of electromagnets corresponds with one of the plurality of ferromagnetic members; and a controller electrically connected to the plurality of electromagnets, wherein the controller is configured to actuate one or more of the plurality of electromagnets to magnetically couple one or more of the plurality of electromagnets to a corresponding ferromagnetic member of the plurality of ferromagnetic members to control a resistance force applied to the carriage.

11. The exercise machine of claim 10, wherein the carriage is movable between a first position and a second position, wherein when the carriage is in the first position the plurality of electromagnets are positioned near the plurality of ferromagnetic members.

12. The exercise machine of claim 11, wherein the controller is configured to prevent any switching of any of the plurality of electromagnets to an off-state when the carriage is not in the first position.

13. A method of operating the exercise machine of claim 10, the method comprising:

selecting one or more biasing members from the plurality of biasing members on the exercise machine to engage with the carriage; and sending an on-state signal to selected electromagnets of the plurality of electromagnets to magnetically activate the selected electromagnets, wherein the selected electromagnets correspond to the selected biasing members of the plurality of biasing members.

14. The method of claim 13, including the step of sending an off-state signal to unselected electromagnets of the plurality of electromagnets to magnetically uncouple the unselected electromagnets from corresponding ferromagnetic members of the plurality of ferromagnetic members.

15. The exercise machine of claim 10, wherein the plurality of ferromagnetic members are each comprised of a ferrous material, a ferromagnetic material, or a permanent magnet.

16. The exercise machine of claim 10, wherein the plurality of electromagnets are connected to a mounting bracket affixed to the carriage.

17. The exercise machine of claim 10, wherein the plurality of ferromagnetic members are each aligned with the plurality of electromagnets.

18. The exercise machine of claim 10, further including a bracket connected to the frame, wherein the bracket is adapted to support the plurality of biasing members when the plurality of biasing members are not engaged with the carriage.

19. The exercise machine of claim 10, including a first end platform connected to the frame near a first end of the frame and a second end platform connected to the frame near a second end of the frame.

20. An exercise machine comprising:

a frame having a pair of parallel rails;

a first end platform connected to the frame near a first end of the frame;

a second end platform connected to the frame near a second end of the frame;

a carriage movably connected to the pair of parallel rails, wherein the carriage is adapted to be movable along a portion of the pair of parallel rails;

a plurality of springs;

a plurality of ferromagnetic members, wherein the plurality of ferromagnetic members are each comprised of a ferromagnetic material, wherein each of the plurality of ferromagnetic members are connected to a corresponding spring of the plurality of springs;

a plurality of electromagnets connected to the carriage, wherein each of the plurality of electromagnets corresponds with one of the plurality of ferromagnetic members;

wherein the carriage is movable between a first position and a second position, wherein when the carriage is in the first position the plurality of electromagnets are positioned near the plurality of ferromagnetic members; and a controller electrically connected to the plurality of electromagnets, wherein the controller is configured to actuate one or more of the plurality of electromagnets to magnetically couple one or more of the plurality of electromagnets to a corresponding ferromagnetic member of the plurality of ferromagnetic members to control a resistance force applied to the carriage.

* * * * *